United States Patent [19]

Stenstrom et al.

[11] Patent Number: 5,062,442

[45] Date of Patent: Nov. 5, 1991

[54] APPARATUS FOR MONITORING A FLUID CONDUIT SYSTEM FOR LEAKAGE POINTS

[75] Inventors: Theiss Stenstrøm; Jen J. Mølbæk, both of Nordborg; Poul E. Hyldig, Augustenborg; Bjarne Stræde, Sydals, all of Denmark

[73] Assignee: Danfoss A/S, Nordborg, Denmark

[21] Appl. No.: 461,685

[22] Filed: Jan. 8, 1990

[30] Foreign Application Priority Data

Jan. 18, 1989 [DE] Fed. Rep. of Germany ..... 3901251
Mar. 7, 1989 [DE] Fed. Rep. of Germany ..... 3907209

[51] Int. Cl.[5] ..... G01F 5/00

[52] U.S. Cl. ..... 137/110; 73/202.5; 137/486

[58] Field of Search ..... 137/110, 624.11, 624.12, 137/487.5, 486, 489, 579, 599.1; 73/202.5, 204.26, 197

[56] References Cited

U.S. PATENT DOCUMENTS

| | | | |
|---|---|---|---|
| 1,108,721 | 8/1914 | Dodge | 73/197 |
| 1,979,607 | 11/1934 | Diehl | 73/197 |
| 2,586,060 | 4/1952 | Kronberger | 73/202.5 X |
| 2,594,618 | 4/1952 | Booth | 73/202.5 X |
| 3,447,775 | 6/1969 | Katchka et al. | 137/489 X |
| 3,470,896 | 10/1969 | An Werter | 73/197 X |
| 3,803,912 | 4/1974 | Ohno | 73/197 X |
| 4,226,259 | 10/1980 | Szekely et al. | 137/489 X |
| 4,461,173 | 7/1984 | Olin | 73/202.5 |
| 4,542,650 | 9/1985 | Renken et al. | 73/204.26 X |
| 4,653,321 | 3/1987 | Cunningham et al. | 73/197 |
| 4,735,231 | 4/1988 | Jacquet | 137/486 X |
| 4,911,200 | 3/1990 | Ben-Arie | 137/624.12 X |

*Primary Examiner*—Stephen M. Hepperle
*Attorney, Agent, or Firm*—Wayne B. Easton; Clayton R. Johson

[57] ABSTRACT

The apparatus functions for monitoring small leakages in order to activate an alarm in the event that there has been more than a predetermined volume of small leakage through the water taps or other part of the system and to automatically turn off a main valve if flow continues therethrough more than a predetermined time and will allow the main valve to open if the discharge of fluid is temporary stopped. The system includes a main valve having a valve seat and a shunt circuit that bridges the valve seat. The shunt circuit includes a volume flow meter and a shunt valve for blocking fluid flow through the circuit. The main valve opens only when the volume in the shunt path exceeds a predetermined value. The shunt circuit includes a throttle that when fluid flows therethrough, provides a pressure drop in the shunt circuit which results in the main valve diaphragm opening when the shunt circuit predetermined value is exceeded. Control apparatus ascertains the volume of fluid flow through the measuring portion of the shunt circuit and controls the closing the shunt valve.

18 Claims, 2 Drawing Sheets

APPARATUS FOR MONITORING A FLUID CONDUIT SYSTEM FOR LEAKAGE POINTS

The invention relates to an apparatus for monitoring a fluid conduit system for leakage points, comprising a main valve which closes a main flow path for the fluid and is bridged by a shunt path closable by a shunt valve.

Conduit systems for fluids have to be monitored for escapes and leakage points. This applies basically to all conduit systems, regardless of whether they are employed for conveying mains water in a house, heating liquid in heating or remote heating systems or gases or fuel in distribution circuits.

In particular, the monitoring of mains water circuits in buildings has assumed an increasing importance in recent years. The problem will be explained by way of example with reference to a mains water installation in a residential building. Normally, the consumption of water when a consumer takes water from a water tap amounts to between about 50 and 1,500 l/h. In extreme cases, such as the cisterns of water closets or a washing machine, it may also be 30 to 2,500 l/h. Leakage points caused by a pipe fracture or bursting of a supply hose for a washing machine or a dishwasher usually account for 500 to 2,500 l/h and in some cases higher and can therefore not be differentiated from the normal consumption. Such a "large leak" is generally monitored over a limited period, i.e. irrespective of whether water is being consumed or there is a large leak, the supply of water is stopped ofter a certain withdrawal period if the volumetric flow during the entire period has exceeded a predetermined value.

A difference is made for defects which will hereinafter be referred to as a "small leak". The loss of water is here somewhat in the region of 1 to 25 l/h and can be caused on the one hand by dripping water taps and overflowing toilet cistems and on the other hand by untight pipe connections, the start of fatigue failures in pipes on account of corrosion, hair cracks in pipes and vessels or like faults in the conduit system. Whereas the first group of examples may not be directly dangerous but only increase the costs for fresh water and drainage and thereby impose on the resources for drinking water and hence the environment, small leaks of the second kind can cause severe damage. The leaving amount of 1 to 25 l/h may appear very low but, over a prolonged period, it can cause intensive dampness in walls or other parts of the building that will no longer be repairable. The resulting damage is often detected too late because dampness starts on the inside of a wall and becomes visible only when the entire wall is already damp. On the other hand, with a timely warning, the damage can be limited because, to repair the water conduit in question, it is generally only necessary to make a small opening in the wall. For conduit systems which do not carry drinking water, e.g. in the case of remote heating installations, it may even be sufficient to introduce a sealing mass into the water which will then re-seal the faulty locations.

In a known arrangement (GB-PS 20 34 392), the main valve is opened only for a limited period to allow water to flow from the source such as a city's mains system when a consumer withdraws water from the conduit system. After closing the main valve, the shunt valve remains open for a predetermined period to ensure, for example, that the cistern of a toilet will be completely filled. However, this arrangement only enables large leaks to be eliminated. Small leaks remain undetected. When the pressure on the mains side of the main valve has dropped off sufficiently on account of a small leak, the main valve will open temporarily to allow water to flow.

DE-OS 21 58 901 discloses means for testing for leaks in installations carrying gaseous or liquid media. These means provide for a non-closable shunt passage containing a volumetric flow meter in the form of a wheel with vanes or a tiltable flap. After closing the main valve, this is intented to check whether gas is escaping from the conduit system downstream of the main valve. Upon exceeding a predetermined volumetric flow, the main valve can no longer open but the gas can continue to flow in the shunt path. In addition, vane-type rotary meters are unsuitable for very small flow quantities because they possess a relatively large amount of friction. Further, the bearings wear out very rapidly, especially when, as in DE-OS 21 58 901, a large volume also flows through the shunt passage when the main valve opens. The total amount of volumetric flow divides up in relation to the flow resistances in the main and shunt passages. After a shorter or longer operating period, therefore, the value of the smallest amount of flow to be measured is increased.

In a known central heating system (Wo 87/04520), two vane-wheel volumetric flow meters are disposed in the supply and return. The output signal for both meters is compared and, if there is a difference between the two volumes, a leakage is suspected. The circuit is closed down. However, since these volumetric flow meters are provided for the main flow, i.e. large amounts of liquid, they are unable to detect small leakages with the required degree of accuracy.

It is the problem of the present invention to provide an apparatus for monitoring a fluid conduit system for leakage points, which apparatus is also able to detect small leaks reliably.

This problem is solved in an apparatus of the aforementioned kind in that the shunt path contains a volumetric flow meter and the degree of opening of the main valve is a function of the flow volume in the shunt path, the main valve opening only when the volume in the shunt path exceeds a predetermined value.

According to the invention, small amounts, i.e. a small volumetric flow, pass exclusively through the shunt path and can there be reliably detected by the volumetric flow meter. It is only when the volume increases and exceeds a predetermined value, e.g. the upper limit of the measuring range of the volumetric flow meter, that the main valve opens. With a volume beyond the measuring range of the flow meter, the cause can only be used by a consumer or a large leak but not a small leak. The exact determination of the volume that is flowing is no longer necessary. In the present invention, the shunt path therefore serves two functions. First, it enables precise measurement of small amounts used up in the conduit system. Second, it controls the main valve, i.e. releases the main valve when its capacity is exceeded. This provides an optimum solution for all possible operating conditions.

In a preferred embodiment, the main valve is an auxiliary power-controlled valve which is controlled by the pressure in a pressure section of the shunt path that is separated from the main path by a throttle section which acts as a throttle. With a large volume of flow through the shunt path, a correspondingly high pressure drop occurs at the throttle section so that the absolute pressure in the pressure section decreases. The main valve can thereby be opened. No seperate control is therefore necessary for the main valve to protect the shunt path from excessively large volumes. With correct dimensioning, the main valve opens automatically when the volume through the shunt path becomes too high and, for example, leaves the measuring range of the volumetric flow meter.

Advantageously, a check valve which opens towards the pressure section is provided in the shunt path upstream of the pressure section. This valve permits flow from the inlet into the conduit system to be monitored but not in the opposite direction. A check valve is often prescribed, for example to prevent water from flowing from a house back to the waterworks. Location in the shunt path achieves two advantages. For one thing, the check valve is opened and therefore cleaned even at low amounts of liquid flow. Binding or jamming are thereby substantially avoided. For another, the check valve may be made considerably smaller because the return flow checking function is assumed by the main valve which closes when the pressure in the conduit system to be monitored and thus in the pressure section becomes larger than the mains pressure.

In addition, it is of advantage for the check valve to form the throttle section.

In a preferred embodiment, the main valve is in the form of a diaphragm valve. On the side of the diaphragm which, together with a valve seat, closes the main flow path, a zone is provided on which the supply pressure acts, the pressure in the pressure section of the shunt passage acting on the opposite side. This makes simple use of the pressure drop across the throttle section to operate the main valve.

In a particularly preferred embodiment, the shunt valve in the shunt path is disposed downstream of the pressure section. Upon closure of the shunt valve, i.e. when the shunt flow through the shunt path is stopped, the main valve is likewise automatically moved to the closed position. This is because the pressure in the pressure section rises so that the main valve is closed.

With particular advantage, laminar flow exists in the measuring path of the volumetric flow meter for a volume within a predetermined measuring range, wherein the measuring path is provided with at least one heat source and a device for detecting the temperature of the fluid prior to heating by the heat source and wherein provision is also made for evaluating means which determine the flow from the temperature and from the amount of heat delivered by the heat source. A volumetric flow meter of this kind does not require moving parts. The delivered amount of heat is a measure of the volumetric flow. The more fluid passes through the measuring path per unit time, the more heat is delivered by the heat source to the fluid. However, the temperature of the fluid also plays a decisive part in the heat transmission. A colder fluid absorbs more heat than a warmer fluid. For this reason, the volumetric flow meter also detects the temperature increase of the fluid caused by the heat source. The temperature and the delivered amount of heat suffice to determine the volumetric flow. A volumetric flow meter of this type can also be employed independently of the leakage monitoring apparatus.

Advantageously, the device for detecting the temperature difference comprises two temperature sensors formed by thin layer metal foil resistors to which a constant voltage is applied, wherein the downstream foil resistor simultaneously serves as a heat source and the upstream foil resistor serves to detect the temperature of the fluid. With practically all ohmic resistors, the resistance changes with the temperature. Since the relationship between the temperature and resistance for individual resistor materials is known, the application of a constant voltage enables one to determine a current which is proportional to the temperature of the thin layer metal foil resistor.

This produces a temperature sensor in a simple manner. Merely by measuring the current at a constant voltage, one also obtains a value for the energy supplied to the resistor. The energy fed to the resistor heats the metal foil until equilibrium is created between the energy supplied and the energy withdrawn. The delivered heating current is fed to the fluid flow by the metal foil by way of the foil carrier, the wall of the pipe and the boundary layer of the flowing medium. Whereas the resistance to heat conduction by the foil support and the pipe wall is constant and thereby causes a constant temperature drop for a given heating current, the conduction of heat in the boundary layer depends on the flow speed of the fluid and its temperature. The larger the speed, the smaller is the temperature drop from the inside of the pipe to the fluid. This temperature difference amounts to about 2 to 6 K, depending on the volume of flow. If the fluid temperature is known, the supplied energy and the temperature of the foil resistor can be used to calculate the speed of flow and from this the volume of flow. The fluid temperature is detected by the upstream foil resistor. It produces such a low heat output that the temperature difference between the resistor and the fluid is insignificant.

Preferably, the measuring path is formed by a pipe bend with the outside of which the temperature sensor is mechanically and thermally connected and spaced at a predetermined distance from each other. With correct dimensioning within certain limits, laminar flow can be readily produced in a pipe bend. Since the temperature sensors are disposed on the outside of the pipe bend, they are subject to less danger of corrosion. The temperature relationship between the fluid and the temperature sensors can be readily determined from the known thermal transmission properties of the pipe bend.

With advantage, the electrical resistance of the upstream temperature sensor is about 10 times as large as the electrical resistance of the downstream temperature sensor. Both sensors can therefore have the same voltage applied to them, the second sensor delivering power which is about 10 times higher. By reason of the temperature increase of the resistors after supplying the energy, the resistance and thus the delivered power will vary somewhat. However, the power output need not be constant as long as there is a difference between the power delivered by the two temperature sensors.

In a preferred embodiment, the evaluating means comprise a resistance measuring circuit which measures the actual resistance of the temperature sensors and a microprocessor connected thereto by way of an A/D converter for calculating the volumetric flow. To enable not only the volumetric flow but also the quantity from the leak to be measured, a control apparatus is provided which is connected to the volumetric flow meter and the shunt valve and comprises an integrator which at least intermittently integrates the flow through the flow meter. This makes a second parameter available to evaluate the leak, namely the outflowing amount of fluid.

With advantage, the control apparatus comprises a backspace circuit which sets the integrator back to or through a predetermined value when the volumetric flow drops by a predetermined value. It can happen, that a user has forgotten to close a water tap properly, so that the tap drips. The control apparatus will likewise evaluate this dripping tap as a leakage point and summate the amount of fluid flowing from the tap as though it were to trickle into the wall from a defective pipe. Some time later, the user discovers his mistake and closes the water tap. The leak now disappears. This information is also received by the control apparatus because it continuously evaluates the volume of flow. Thus, if the volume decreases, it is clear that the assumed leak was not a true leak and measurement of the real volume of leakage must start afresh.

With advantage, the control apparatus feeds the output volume of the volumetric flow meter to the integrator only when it exceeds a predetermined first volume. This is because flow volumes below about 1 l/h are not to be detected. Such a leakage is regarded to be negligible and is therefore not to affect the measurements.

In a preferred embodiment, the control apparatus actuates a display when the integrator has detected a predetermined first volumetric value. This can, for example, be the case when the integrator discovers that a total of 60 l have disappeared from the conduit system through a leak. The user is then warned and can check all the water taps to see whether they are dripping. Alternatively, if he finds no dripping water tap, he can check the conduit system for small leaks and repair them.

It is in this case of advantage for the control apparatus to return the integrator to zero after reaching the first volumetric value and to introduce a new integration if the volumetric flow does not exceed a second predetermined volumetric value which is larger than the first. As long as the volume is larger than 1 l/h, but less than, say, 3 l/h, there is no acute danger. It is not necessary to close the main valve at this stage. It is, however, of interest to continue to monitor the volume. The integral should likewise be continued to be formed, i.e. the amount detected that has flowed out of the system through a leak. One can, of course, limit the number of repeated integrations so that, for example, after the third, fourth or fifth time of reaching the predetermined first volume, the shunt valve and thus the main valve are closed to avoid further trickling of fluid from the small leak.

It is also of interest that the control apparatus locks the shunt valve in the closed position when the integrator has found a predetermined second volumetric value. If the volume is larger than a predetermined second volumetric value, the integrator will not be returned to zero upon reaching the first volumetric value but it will continue to determine what quantities flow out of the conduit system through the leak. Naturally, on reaching the first volumetric value, an indicator or alarm may be actuated. This ensures that, in the case of a larger leakage flow, the system will be reliably shut down to prevent permanent damage by the outflowing fluid.

In a preferred embodiment, the control apparatus closes the shunt valve a predetermined interval after the volumetric flow has reached a predetermined third volumetric value which is larger than the second volumetric value. This automatically also closes the main valve. The third volumetric value is the lower limit for a flow during legitimate consumption or in the case of a large leak. Since the apparatus cannot differentiate between consumption and a large leak, one simply limits the maximum time for which the flow can pass through the main valve. This time can be such that, for example, the user can fill a bath or have a generous shower. Should the maximum tapping time expire for example while the user still needs water, he can, if closing of the main valve is signalled in good time, return a signal to the control apparatus by closing the tap, whereupon the control apparatus will open the main valve again or hold it open. On the other hand, a large leak cannot be closed in such a short time. Thus, water can flow through a large leak only for a particular time and this helps to keep damage to a minimum.

Preferred examples of the invention will now be described with reference to the drawing, wherein.

Figure 1:
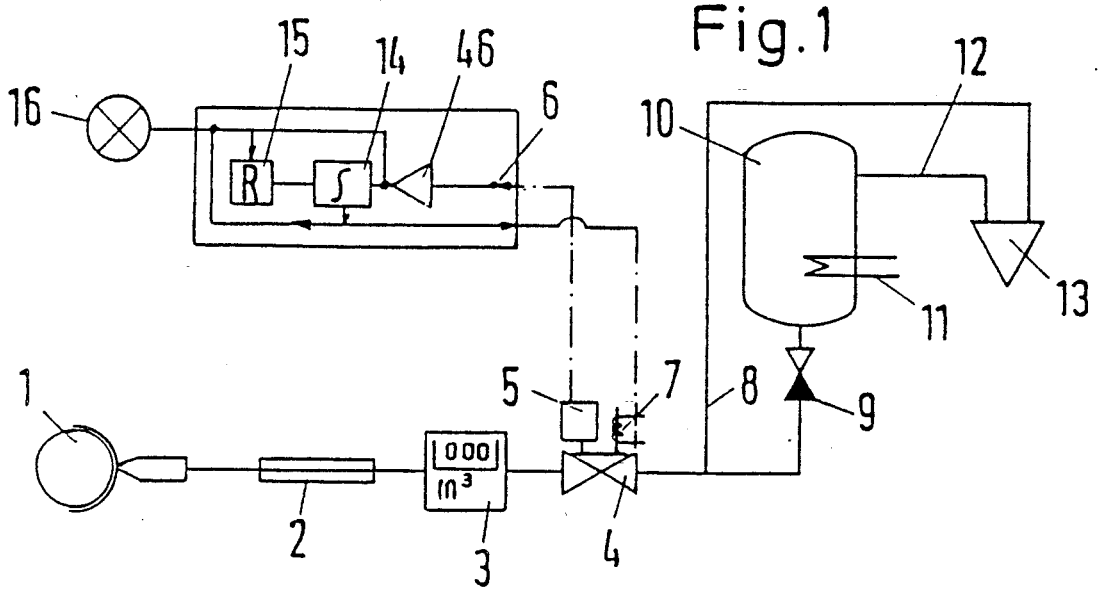
FIG. 1 is a diagram of a mains water system.
Figure 2:
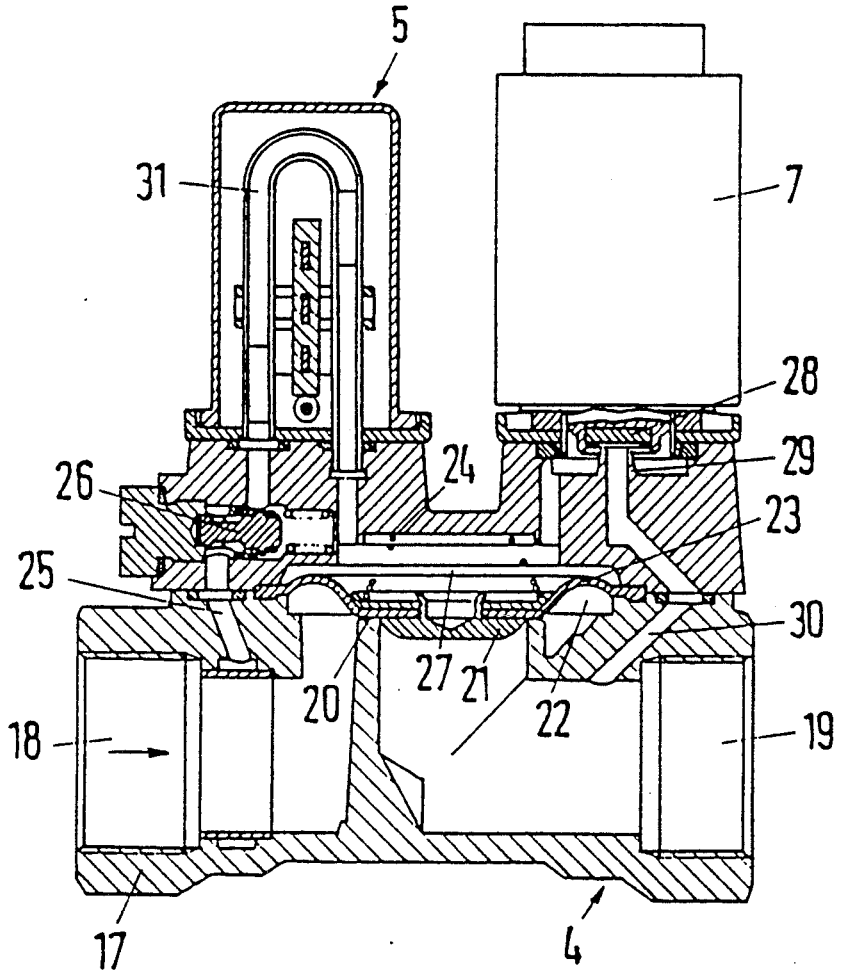
FIG. 2 shows a main valve with a shunt path connected in parallel.
Figure 3:
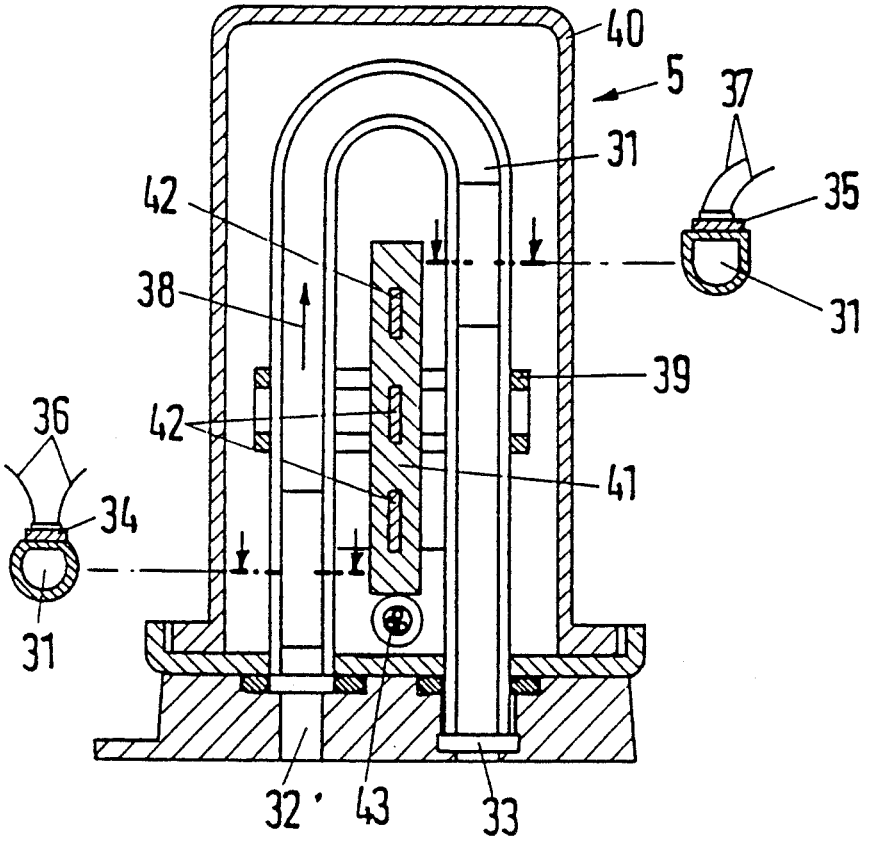
FIG. 3 illustrates a volumetric flow meter.

From a supply conduit 1, for example a mains water circuit of a waterworks, mains water is fed through an inlet 2, i.e. a house inlet, into a residential building. It there flows through a meter 3 to a stopcock or main valve 4 which can be opened or closed by a valve actuating element 7. At the main valve 4, there is a volumetric flow meter. The flow meter 5 as well as the valve actuating element 7 are connected to a control apparatus 6. Downstream of the stopcock, a cold water conduit 8 branches off and leads to a tapping point 13. Another conduit leads by way of a return flow preventing valve 9 (which only permits the flow of water away from the valve 4) into a hot water vessel or preparer 10 where the water is heated by a heater 11. A warm water conduit 12 connects the hot water vessel 10 to a tapping point 13.

The main valve has a housing 17 with a supply 18 and a discharge 19. The supply 18 and discharge 19 are separated by a diaphragm valve comprising a diaphragm 23 communicating with a closure element 21 which, together with a valve seat 20, closes or releases the main flow path between the supply 18 and discharge 19. The diaphragm 23 is pressed against the valve seat 20 with the aid of a spring 24.

Branching from the supply 18 there is a shunt flow path 25 which leads to the volumetric flow meter 5 by way of a return flow preventer, for example a check valve 26. The check valve 26 serves to prevent pressure peaks in the conduit system to be monitored from affecting the mains and above all to prevent water from flowing from the conduit system to be monitored back to the waterworks. Downstream of the volumetric flow meter, the shunt flow path 25 leads to a pressure section 27 and then by way of a shunt valve having a closure element 28 acting against a valve seat 29 to a shunt passage outlet 30 which opens into the discharge 19 of the main valve 4.

The shunt flow path 25 acts as a throttle from its commencement at the supply 18 up to the point where it opens into the pressure section 27. The largest part of the throttle effect is produced by the check valve 26. This permits the water in the remaining section to flow without eddying and thus in a linear flow. The check valve forms a throttle section. It will now be assumed that the valve actuator 7 of the shunt valve has lifted the closure element 28 off its valve seat 29. The spring 24 presses the diaphragm 23 downwardly so that the closure element 21 lies against the valve seat 20. The main flow path is thereby blocked. If water escapes from the conduit system, i.e. from the cold water conduit 8, the hot water conduit 12 or the hot water vessel 10, this water is replenished from the supply 18 through the shunt path 25. This amount of water is detected by the volumetric flow meter 5. However, if the required amount of water exceeds a predetermined value, i.e. if the volume flowing through the shunt path 25 increases, so will the pressure drop in the throttle section, i.e. the absolute pressure in the pressure section 27 will fall. On the other side of the diaphragm 23, however, the full supply pressure is applied at least to an annular section which covers an annular passage 22. When the supply pressure acting on this part of the diaphragm 23 produces a larger force than the pressure in the pressure section 27 together with the force of the spring 24, the closure element 21 will lift off the valve seat 20 and thus open the main path from the supply 18 to the discharge 19. As long as an adequate pressure drop is produced across the throttle section, i.e. as long as an adequate volume flows through the shunt flow path 25, the main valve 4 will remain open. The throttle effect of the throttle section will be sensibly set so that the main valve opens when the volume flowing through the volumetric flow meter exceeds the measuring range. The measuring range is provided so that it only detects small leaks, i.e. leaks causing an escape of fluid below 25 l/h. A volume above this limit will be regarded as consumption or a large leak, in which case an accurate knowledge of the value of this fluid will not be necessary.

If there is a tendency for water to flow back to the mains from the conduit system to be monitored, whether this be because of a pressure drop in the mains or a pressure rise in the system to be monitored, part of the water will flow through the shunt path, whereby the return preventing means or check valve 26 will close. The pressure in the pressure section 27 will then become larger than the pressure in the supply 18 and the diaphragm 23 will close the main valve.

The entire volumetric flow meter 5 is protected by a cap 40 from external influences. The measuring path 31 of the volume meter 5 communicates by way of a connection 32 with the part of the shunt path 25 leading to the supply 18 and by way of a connection 33 with the pressure section 27 of the shunt path. The measuring path 31 is so designed that there is a laminar flow within it for a volume within the measuring range of the flow meter. Applied to the measuring path 31 there are two thin layer metal foil resistors 34 and 35 connected to the control apparatus 6 by way of cables 36, 37 which are combined to a cable harness 43. The measuring path 31 is connected by a holder 39 to a connecting rail 41 which also receives the conduits 36, 37 leading away from the resistors 34, 35. At each of the two thin layer metal foil resistors, a constant voltage is applied which may be the same for both resistors. The resistances differ by about the factor 10, the larger resistance being upstream of the other.

Each voltage drives a particular current through the respective resistor. Since the resistance depends on temperature, the volume of the current is indicative of the temperature of the metal foil resistor 34 or 35. At the same time, the voltage and current permit one to obtain an indication of the electric power fed to the resistors. By reason of the laminar flow in the measuring path 31, one can assume that the heat transmission from the resistors to the fluid is proportional to the volume of flow. The larger the volume, the more heat is dissipated. Of course the dissipated heat also depends on the temperature of the fluid.

The upstream or first thin layer metal foil resistor 34 as viewed in the direction 38 of flow is supplied with only a relatively small amount of electric power of, for example, 10 mW so that the foil temperature is only negligibly higher than the temperature of the fluid and the fluid temperature is not markedly increased. In the other resistor 35, on the other hand, more electric power is consumed, e.g. 100 mW, so that a much higher heating current is produced. The foil temperature is thus very much higher than the fluid temperature. At a particular temperature, the dissipated heat becomes equal to the supplied electric power. From the temperature difference $\Delta T$ between the two foil resistors 34, 35, the supplied heat flow A and the thermal transmission resistance B between the foil resistors 34, 35 and the fluid flowing in the measuring path 31, one can obtain a useful measure for the volumetric flow V:

$$V = o \times A/(\Delta T - B)^2$$

wherein c is a proportionality constant.

The evaluating means 6 comprise (but this is not illustrated) a resistance measuring circuit for each resistor and a conventional A/D converter which digitalises the determined resistances and feeds them to a microprocessor which determines the temperature difference and processes same according to the above mentioned formula to calculate the volumetric flow.

The volumes determined by the volumetric flow meter 5 are fed to the control apparatus 6. The control apparatus 6 determines with the aid of a comparator 46 whether the volume exceeds a predetermined first value. This first value is, for example, 1 l/h. At a loss of less than 1 l/h the conduit system is considered to be leak proof. However, if the volume increases to above 1 l/h, the measured value is fed to an integrator 14 which continuously integrates the value. So long as the volume is smaller than a predetermined second value, i.e. 3 l/h, the integrator 14 actuates an indicator 16 when a certain amount of leakage flow has left the system, i.e. 60 l. If the volume lies below the second value, a resetting device 15 returns the integrator 14 to zero and the integrator starts afresh. Naturally, a limit may be provided as to how often the integrator can integrate from zero up to the predetermined first leakage value without closing down the system altogether. However, if the volume is larger than the predetermined second value, the integrator is not reset to zero when reaching the first value for the volume. It merely actuates the display 16. If the integrator 14 then finds that a second volume has been reached, it blocks the shunt valve by way of the actuating element 7. This creates in the pressure section 27 a pressure which corresponds to the supply pressure and moves the diaphragm 23 downwards so that the closure element 21 is pressed against the valve seat 20.

If the volume exceeds a predetermined third value, the main valve 4 opens automatically. The measurements of the flow meter 5 are now meaningless. The control apparatus contains a time element (not shown) which now keeps the main valve open for a predetermined time. If the time has run out without the main valve closing, the control apparatus 6 will close the shunt valve by way of the valve actuating element 7, whereby the main valve is closed automatically. This is intended to prevent an excessive amount of fluid from escaping the conduit system in the case of a large leak. If the large volume is not caused by a large leak but, for example, by a consumer who wants to wash his car or water the garden, the main valve would likewise be closed.

However, this is indicated in good time. The user can then send a timely signal to the control apparatus 6 by momentarily closing the tapping point 13 to indicate that there is no large leak but legitimate consumption. In this case, the control apparatus 6 commands the valve actuating element 7 to re-open the shunt valve and thus the main valve 4 or to keep them open.

Now, it may happen that the small leak is caused by a dripping tap. The integrator 14 integrates the escaping leakage volume. After a certain time, the user becomes aware of the dripping water tap and closes it properly. The evaluating means 6 register the fact that the volumetric flow has decreased so that the leakage up to that time was obviously not a true leak in the sense of leakage monitoring. It therefore sets the integrator 14 back to zero and restarts the monitoring.

The display device 16 may also be actuated when the leakage flow assumes an excessively large value irrespective of how much fluid has already left the system.

We claim:

1. Apparatus for monitoring a fluid conduit system for leakage points, comprising a main valve having a housing that includes an inlet, an outlet, and a valve seat interposed between the inlet and outlet, and a fluid flow responsive valve member in the housing operable between an open and a closed position for controlling fluid flow through the valve seat, and volumetric flow meter shunt means for defining a flow shunt flow path that opens to the inlet and outlet, bridging the valve seat and opening to the main valve member for controlling the opening of the valve member as a function of the flow volume in the shunt path and maintaining the main valve member closed until the volume in the shunt path exceeds a predetermined value, the shunt means including a volumetric flow meter for measuring fluid flow through the flow path, an operable shunt valve connected in series with the flow meter between the inlet and outlet for selectively permitting and blocking fluid flow through the flow path, and control means connected and acting at least in part in response to the flow through the flow meter for controlling the operation of the shunt valve.

2. The apparatus according to claim 1, characterized in that the main valve is a power assisted valve controlled by pressure, the valve member being operable between its positions by fluid pressure, and that the shunt means includes a pressure section opening to the valve member for applying fluid pressure to the valve member to retain the valve member in its closed position until flow in the shunt path exceeds the predetermined value and a throttle section disposed between one of the inlet and valve member and the valve member and the outlet.

3. The apparatus according to claim 2 characterized in that the main valve member comprises a diaphragm having a first side abutable against the valve seat for blocking flow through the valve seat and an opposite side exposed to the pressure section in the shut path.

4. The apparatus according to claim 2, characterized in that shunt means includes a shunt valve disposed in the shunt path between the pressure section and the outlet.

5. The apparatus according to claim 1, characterized in that the shunt means includes a measuring section having laminar flow therethrough, a first heat source for heating fluid flowing through the measuring section, detecting means for detecting the temperature of the fluid prior to heating by the heat source, and evaluating means for determining the flow volume from the temperature detected by the detecting means and the amount of heat given off by the heat source.

6. The apparatus of claim 5, characterized in that the detecting means includes first and second temperature sensors, the sensors respectively comprising first and second thin-layer metal foil resistors adapted for having a constant voltage applied thereto with the first resistor being downstream of the second resistor and defining the first heat source, and the second resistor serves to determine the temperature of the fluid.

7. Apparatus for monitoring a fluid conduit system for leakage points, comprising a main valve having a housing that includes an inlet, an outlet, and a valve seat interposed between the inlet and outlet, and a valve member in the housing operable between an open and a closed position for controlling fluid flow through the main valve seat, and volumetric flow meter shunt means for defining a shunt flow path that opens to the inlet and outlet, bridging the valve seat and controlling the opening of the valve member as a function of the flow volume in the shunt path and maintaining the main valve member closed until the volume in the shunt path exceeds a predetermined value, the shunt means including a flow meter having a first shunt section, a valve actuating element having a second shunt section that includes a shunt valve, the shunt valve having a valve seat and a closure member for closing and opening the fluid flow path through the shunt valve seat, an actuating element for controlling the opening and closing of the closure member, and control means for controlling the actuating element, the control means being connected to the flow meter and the actuating element and including an integrator that intermittently integrates the flow through the first shunt section, a measuring section having laminar flow therethrough, a first heat source for heating fluid flowing through the measuring section, detecting means for detecting the temperature of the fluid prior to heating by the heat source, and evaluating means for determining the flow volume from the temperature detected by the detecting means and the amount of heat given off by the heat source, the detecting means including first and second temperature sensors, the sensors respectively comprising first and second thin-layer metal foil resistors adapted for having a constant voltage applied thereto with the first resistor being downstream of the second resistor and defining the first heat source, and the second resistor serving to determine the temperature of the fluid.

8. The apparatus of claim 7, characterized in that the control means includes a resetting circuit for at least one of setting the integrator back and through a predetermined value when the flow volume through the flow meter decreases by a predetermined value.

9. The apparatus of claim 7, characterized in that the control apparatus includes means for feeding the integrator the output value of the flow meter only when the output value exceeds a predetermined first value.

10. The apparatus of claim 7, characterized in that the control means includes means for locking the shunt valve closure member in its closed position when the integrator has detected a first predetermined flow value of the flow through the flow meter and then a second predetermined flow value of flow through the flow meter.

11. The apparatus of claim 7, characterized in that the control means includes means for operating the actuating element to operate the closure member to its closed position after a first predetermined flow value of flow through the flow meter has been determined, then a second predetermined flow value of flow through the flow meter has been determined and thence after a third predetermined flow value of flow through the flow meter that is higher than the second value has been determined.

12. The apparatus of claim 7, characterized in that the control means includes an actuatable display and means for actuating the display when the integrator has detected a predetermined first volume flow through the flow meter.

13. The apparatus of claim 12, characterized in that the control means includes means to reset the integrator to zero after the volume flow through the flow meter has exceeded a first predetermined value and renews an integration if the volume does exceed a predetermined second volume larger than the first volume.

14. Apparatus for monitoring a fluid conduit system for leakage points, comprising a main valve having a housing that includes an inlet, an outlet, and a main valve seat interposed between the inlet and outlet, and a main valve member in the housing operable between an open and a closed position for controlling fluid flow through the valve seat, and volumetric flow meter shunt means acting in cooperation with the housing for defining a shunt flow path that opens to the inlet and outlet for conducting fluid between the inlet and the outlet, bridging the valve seat and controlling the opening of the main valve member as a function of the flow volume in the shunt path and maintaining the main valve member closed until the volume in the shunt path exceeds a predetermined value, the shunt means including a first fluid passage opening to the inlet, a volumetric flow meter that includes a tubular measuring portion having a first end and an a downstream second end portion, a throttle for fluidly connecting the first passage to the measuring portion, a shunt valve that in part defines the flow path and has a shunt valve seat, a second passage fluidly connecting the shunt valve seat to the outlet, a third passage having a first end opening to the shunt valve seat opposite the opening of the second passage to the valve seat and a second end and a shunt valve member operable under fluid pressure for blocking fluid flow from the third passage to the shunt valve seat and thereby though the flow path, and a fluid pressure section fluidly connected to the third passage second end and the measuring portion second end for applying fluid pressure on the main valve member to retain the main valve member in its closed position until the flow through the measuring section exceeds a predetermined value and control means for measuring the volume flow through the measuring section for determining first and second predetermined values of volume flow through the flow meter and applying a pressure to the shunt valve member to move the shunt valve member to its closed position a predetermined interval after the second predetermined value has been reached, the second predetermined value being larger than the first predetermined value.

15. The apparatus of claim 14 further characterized in that the throttle comprises a check valve oriented in a direction to permit fluid flow from the inlet to the measuring portion.

16. Apparatus for monitoring a fluid conduit system for leakage points, comprising a power assisted main valve controlled by pressure and having a housing that includes an inlet, an outlet, and a valve seat interposed between the inlet and outlet, and a valve member in the housing operable under fluid pressure between an open and a closed position for controlling fluid flow through the valve seat, and volumetric flow meter shunt means for defining a shunt flow path that opens to the inlet and outlet, bridging the valve seat and controlling the opening of the valve member as a function of the flow volume in the shunt path and maintaining the main valve member closed until the volume in the shunt path exceeds a predetermined value, the shunt means including a pressure section opening to the valve member for applying fluid pressure to the valve member to retain the valve member in its closed position until flow in the shunt path exceeds the predetermined value and a throttle section disposed between one of the inlet and valve member and the valve member and the outlet, the throttle section comprising a check valve between the inlet and pressure section that opens under fluid pressure in a direction toward the pressure section.

17. Apparatus for monitoring a fluid conduit system for leakage points, comprising a main valve having a housing that includes an inlet, an outlet, and a valve seat interposed between the inlet and outlet, and a valve member in the housing operable between an open and a closed position for controlling fluid flow through the valve seat, and volumetric flow meter shunt means for defining a shunt flow path that opens to the inlet and outlet, bridging the valve seat and controlling the opening of the valve member as a function of the flow volume in the shunt path and maintaining the main valve member closed until the volume in the shunt path exceeds a predetermined value, the shunt means including a measuring section having laminar flow therethrough, a first heat source for heating fluid flowing through the measuring section, detecting means for detecting the temperature of the fluid prior to heating by the heat source, and evaluating means for determining the flow volume from the temperature detected by the detecting means and the amount of heat given off by the heat source, the detecting means including first and second temperature sensors, the sensors respectively comprising first and second thin-layer metal foil resistors adapted for having a constant voltage applied thereto with the first resistor being downstream of the second resistor and defining the first heat source, and the second resistor serving to determine the temperature of the fluid, the measuring section comprising a bent pipe section having an exterior surface, the temperatures sensors being mechanically and thermally connected to the pipe bend exterior surface and being at a predetermined spacing along the pipe section from one another.

18. Apparatus for monitoring a fluid conduit system for leakage points, comprising a main valve having a housing that includes an inlet, an outlet, and a valve seat interposed between the inlet and outlet, and a valve member in the housing operable between an open and a closed position for controlling fluid flow through the valve seat, and volumetric flow meter shunt means for defining a shunt flow path that opens to the inlet and outlet, bridging the valve seat and controlling the opening of the valve member as a function of the flow volume in the shunt path and maintaining the main valve member closed until the volume in the shunt path exceeds a predetermined value, the shunt means including a measuring section having laminar flow therethrough, a first heat source for heating fluid flowing through the measuring section, detecting means for detecting the temperature of the fluid prior to heating by the heat source, and evaluating means for determining the flow volume from the temperature detected by the detecting means and the amount of heat given off by the heat source, the detecting means including first and second temperature sensors, the sensors respectively comprising first and second thin-layer metal foil resistors adapted for having a constant voltage applied thereto with the first resistor being downstream of the second resistor and defining the first heat source, and the second resistor serving to determine the temperature of the fluid, the upstream temperature sensor being an electric resistance that is about 10 times as great as that of the downstream resistor.

* * * * *